US011214459B1

(12) United States Patent
Shaw et al.

(10) Patent No.: US 11,214,459 B1
(45) Date of Patent: Jan. 4, 2022

(54) TAPE WRAP DISPENSER

(71) Applicants: Rodney Shaw, Mesa, AZ (US); Stephanie Mitchell-Anthony, Las Vegas, NV (US); Kevin Harris, Frankllin, OH (US); Peggy Edwards-Harris, Franklin, OH (US)

(72) Inventors: Rodney Shaw, Mesa, AZ (US); Stephanie Mitchell-Anthony, Las Vegas, NV (US); Kevin Harris, Frankllin, OH (US); Peggy Edwards-Harris, Franklin, OH (US)

( * ) Notice: Subject to any disclaimer, the term of this patent is extended or adjusted under 35 U.S.C. 154(b) by 0 days.

(21) Appl. No.: 16/420,500

(22) Filed: May 23, 2019

(51) Int. Cl.
*B65H 35/00* (2006.01)

(52) U.S. Cl.
CPC ..... *B65H 35/0086* (2013.01); *B65H 35/002* (2013.01); *Y10T 225/218* (2015.04); *Y10T 225/295* (2015.04)

(58) Field of Classification Search
CPC .. A47K 10/34; A47K 10/3631; A47K 10/365; Y10T 83/8748; Y10T 83/889; Y10T 83/896; Y10T 225/12; Y10T 225/16; Y10T 225/18; Y10T 225/20; Y10T 225/21; Y10T 225/218; Y10T 225/238; Y10T 225/257; Y10T 225/283; Y10T 225/298; Y10T 225/30; Y10T 225/307; Y10T 225/321; Y10T 225/325; Y10T 225/295; B65H 35/0086; B65H 35/002; B65H 35/00; B65H 35/0006; B65H 35/0026; B65H 35/0033; B65H 35/0073; B65H 35/008; B65H 35/04; B65H 35/06; B65H 35/10
USPC ..... 242/159, 160.1, 520, 521, 522, 526, 242/526.1, 570
See application file for complete search history.

(56) References Cited

U.S. PATENT DOCUMENTS

| | | | | |
|---|---|---|---|---|
| 2,750,029 | A * | 6/1956 | Morgan | B65H 35/0026 225/7 |
| 2,802,527 | A * | 8/1957 | Castelli | B65H 35/0026 83/610 |
| 3,796,341 | A * | 3/1974 | Berman | B65H 35/0026 242/588.6 |
| 4,454,204 | A * | 6/1984 | Posey | A63H 5/00 428/11 |
| 4,967,740 | A | 11/1990 | Riedel | |
| 5,698,067 | A | 12/1997 | Packard | |
| 5,735,400 | A | 4/1998 | Packard | |
| D416,582 | S | 11/1999 | Dunshee et al. | |
| D417,237 | S | 11/1999 | Packard et al. | |
| D428,922 | S | 8/2000 | Packard et al. | |

(Continued)

*Primary Examiner* — Phong H Nguyen
(74) *Attorney, Agent, or Firm* — Cramer Patent & Design, PLLC; Aaron R. Cramer

(57) ABSTRACT

A tape wrap dispenser comprising an outer enclosure having a first side with a first aperture, a center section with a tape exit slot, and a second side with a second aperture. Also included are a first release/cut button which is attached to the first side, a second release/cut button which is attached to the second side, and a neck lanyard having a safety quick release routed through both the first aperture and the second aperture. There is a central hub inside the outer enclosure and a tape wrap roll mounted on the central hub and which extends through the tape exit slot. A mechanical linkage connected to the first and second release/cut buttons moves a cutter that cuts the tape at the tape exit slot. The outer enclosure should have a flat surface to prevent rolling.

1 Claim, 6 Drawing Sheets

(56) References Cited

U.S. PATENT DOCUMENTS

| | | | | |
|---|---|---|---|---|
| 6,216,978 | B1 | 4/2001 | Rodriguez | |
| 6,364,188 | B1 | 4/2002 | Dunshee | |
| 6,481,607 | B1 | 11/2002 | Van Cott | |
| 6,688,207 | B2 * | 2/2004 | Tabeling | G02B 6/25 225/103 |
| D645,087 | S | 9/2011 | Fung et al. | |
| 8,408,265 | B2 | 4/2013 | Chang | |
| 8,820,382 | B1 * | 9/2014 | Renkert | B65H 35/0033 156/577 |
| 9,061,854 | B2 | 6/2015 | Wells | |
| 10,625,973 | B2 * | 4/2020 | Shearer | D05C 1/065 |
| 2009/0282961 | A1 * | 11/2009 | Jones | B26D 5/26 83/436.5 |
| 2011/0005688 | A1 * | 1/2011 | Chang | B65H 35/0026 156/523 |
| 2015/0033510 | A1 * | 2/2015 | Nagi | A45F 3/14 24/302 |

* cited by examiner

TAPE WRAP DISPENSER

FIELD OF THE INVENTION

The presently disclosed subject matter is directed to athletic tape wrapping. More particularly it is directed to a sport tape wrap dispenser.

BACKGROUND OF THE INVENTION

Because of the large number of injuries that occur during athletic endeavors there are many different types of sport tape wraps. They range from zinc oxide tapes, to elastic adhesive bandages, kinesiology sport tapes, under-wraps and over-wraps as well as cohesive bandages and the like. Very often such tape wraps come in a range of dimensions and some have adhesive backings.

When sport tape wraps are needed, they are often needed right away. Rapid application of a tape wrap can enable a player to quickly return to play. In other instances, the immediate application of a sport tape wrap can speed healing, reduce swelling, and protect the player from further injuries. Thus, coaches and trainers often keep rolls of tape wraps handy. In the prior art such tape wraps were often kept in a training bag or case. Very often such bags and cases were also used to store other supplies. Searching through a training bag or case to find a given sport tape wrap and then to prepare that tape wrap for use can take valuable time. Even if such sport tape wraps could be found quickly it might still take valuable time to find the end of the sport tape wrap and then to cutting that tape to the desired length.

Accordingly, there exists a need for a sport tape wrap dispensing device by which sport tape wraps can be kept handy and used efficiently. Preferably such a tape wrap dispensing device could be easily carried by a coach or a trainer. Even more preferably such a sport tape wrap dispensing device could enable rapid cutting of a needed length of a sport tape wrap. Ideally such a tape wrap dispensing device would be suitable for use in different sports, with different wraps, and would be easy to use and easy to fill and re-fill. Beneficially, such a tape wrap dispensing device would be safe to use and would be suitable for being made available at low cost.

SUMMARY OF THE INVENTION

The principles of the present invention provide for sport tape wrap dispensing devices suitable for keeping sport tape wraps handy and such that they can be used efficiently. Sport tape wrap dispensing devices in accord with the present invention can be easily carried by a coach or a trainer in a manner such that the sport tape wrap can be rapidly cut to the needed length and quickly applied. Such a sport tape wrap dispensing device is suitable for use in different sports and with different tape wraps. It is easy and safe to use and easy to fill and re-fill. In addition, it is suitable for being made available at low cost.

A tape wrap dispenser in accord with the present invention includes an outer enclosure having a first side with a first aperture, a center section with a tape exit slot, and a second side with a second aperture. Also included are a first release/cut button which is attached to the first side, a second release/cut button which is attached to the second side, and a neck lanyard routed through both the first aperture and the second aperture. Also included is a central hub inside the outer enclosure and a tape wrap roll which is mounted on the central hub and which extends through the tape exit slot.

The tape wrap dispenser may have a plurality of flat surfaces. The first release/cut button might be located at the center of the first side. In addition, the second release/cut button may be diametrically opposed to the first release/cut button. Furthermore, the neck lanyard may include a quick release mechanism. In addition, the central hub may be affixed to the second side. If so, the tape wrap might be mounted on the central hub. Preferably the first side may attach to the center section by a recessed lip and by locking tabs. There may be a cutting blade operatively connected to the first release/cut button such that pressing the first release/cut button moves the cutting blade toward the tape wrap roll. If so, pressing the first release/cut button may cut the tape wrap roll. There may be a linkage cable, such as a Bowden-type cable, connected to the first release/cut button and to the cutting blade. In any event the linkage cable moves the cutting blade. Preferably the outer enclosure will be configured in the shape of a sport that the roll of tape wrap is to be used with.

An alternative tape wrap dispenser will have an outer enclosure having a first side with a first aperture, a center section having a tape exit slot, and a second side with a second aperture. There will be a first release/cut button attached to the first side and a second release/cut button attached to the second side. A neck lanyard will be routed through the first aperture and through the second aperture. There will also be a central hub affixed inside the second side with a tape wrap roll mounted on it such that the tape roll extends through the tape exit slot. There will also be a linkage cable connecting the first release/cut button to a cutting blade. Pressing the first release/cut button will cause the linkage cable to move the cutting blade to at least partially cut the tape wrap roll adjacent the tape exit slot.

In practice that alternative tape wrap dispenser will have an outer enclosure has a flat side, the first release/cut button will be located at the center of the first side, and the second release/cut button may be diametrically opposed to the first release/cut button. In any event the neck lanyard should include a quick release mechanism. The central hub might be affixed inside the second side and the roll of tape wrap may be mounted on the central hub.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
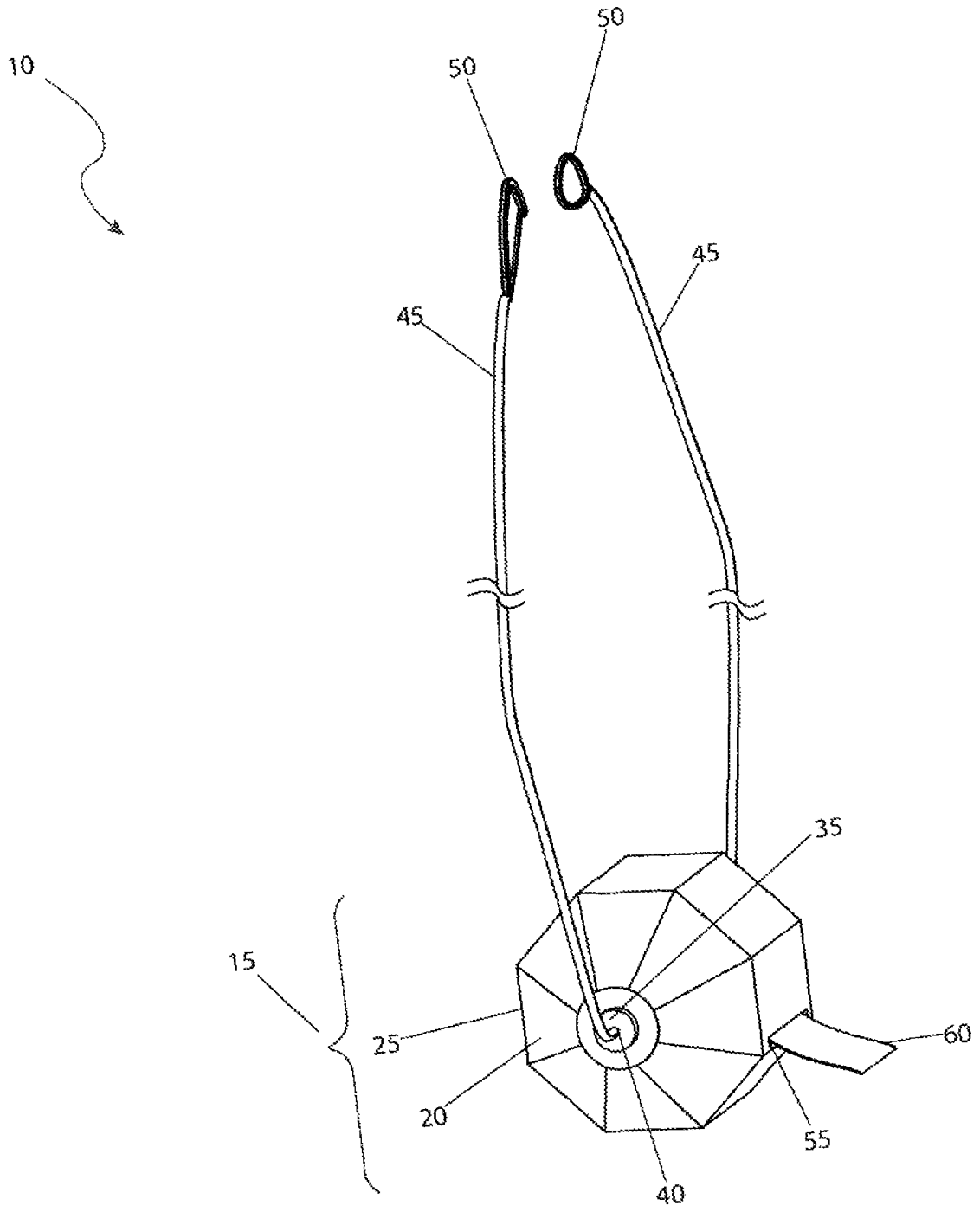
FIG. 1 is a side perspective view of a tape wrap dispenser 10 that is in accord with the principles of the present invention.

10 tape dispenser
15 outer enclosure
20 left side
25 center section
30 right side
35 release/cut button
40 center aperture
45 neck lanyard
50 quick release mechanism
55 tape exit slot
60 tape
65 lines of force "f"
70 recessed lip
75 locking tab
80 central hub
85 roll of tape
90 linkage cable
95 cutting blade
100 tape holding cavity
105 baseball marking indicia
110 football marking indicia
115 basketball marking indicia
120 soccer marking indicia
125 tennis ball marking indicia

DETAILED DESCRIPTION OF THE INVENTION

Embodiments of the present invention are depicted in FIGS. 1 through 9. However, the invention is not limited to the specifically described and illustrated embodiments. A person skilled in the art will appreciate that many other embodiments of the invention are possible without deviating from the basic concept of the invention. Any such work around also falls under the scope of this invention.

The terms "a" and "an" as used herein do not denote a limitation of quantity, but rather denote the presence of at least one of the referenced items.

Refer now to FIG. 1 for a perspective side view of a tape wrap dispenser 10 that is in accord with the present invention. The tape wrap dispenser 10 can be made available in different designs each of which is suitable for the tape wrap to be dispensed. The tape wrap dispenser 10 of FIG. 1 has a generally spherical outer enclosure 15 which is a twenty-six-sided polyhedron. The outer enclosure 15 has nine left side faces 20, eight center section faces 25 (only partially shown in FIG. 1) and nine right side faces 30 (not shown in this Figure due to illustrative limitations but see FIGS. 2 through 4). This shape is simply one example of the many possible shapes. However, it does have the advantage of being easily handled. well balanced, symmetrical, while also proving a centered tape exit slot 55. Furthermore, most importantly the outer enclosure 15 has flat sides the enable the tape wrap dispenser 10 to be placed on a flat surface without rolling.

Figure 2:
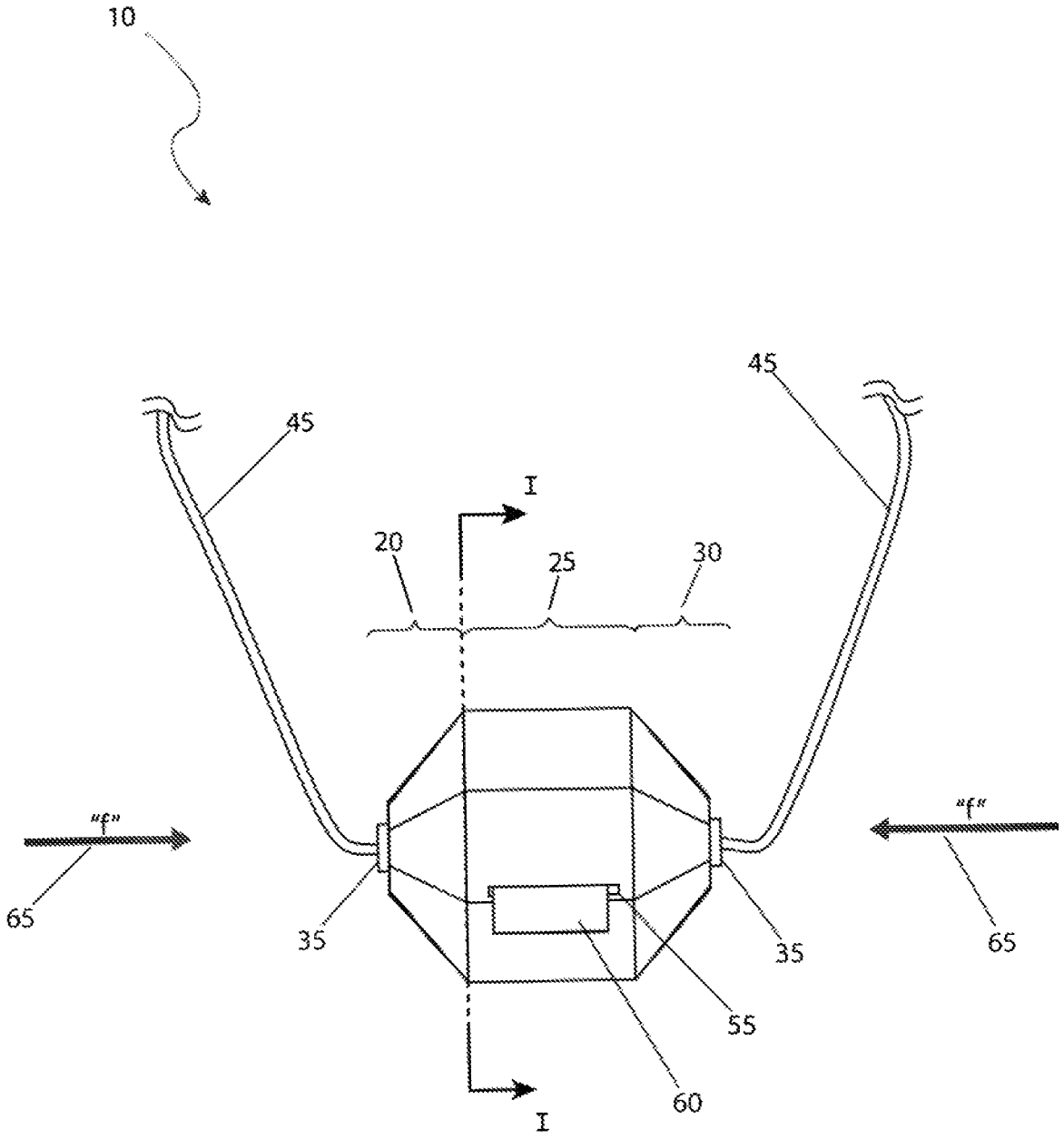
FIG. 2 is a front view of the tape wrap dispenser 10 illustrated in FIG. 1.

The tape wrap dispenser 10 further includes two (2) diametrically opposed release/cut buttons 35 (only one shown in FIG. 1 but see FIG. 2. The release/cut buttons 35 are located at the centers of the left and right-side face centers 20, 30. It should be understood that the release/cut buttons 35 are internally connected. Further information regarding the release/cut buttons 35 is provided below.

Each release/cut button 35 passes through a center aperture 40. In addition, a neck lanyard 45 is routed through those apertures 40. The neck lanyard 45 is designed to be worn around the neck of a user such as a coach or trainer. Importantly, the neck lanyard 45 includes a break-away anti-choke quick release mechanism 50 to ensure user safety. By locating the left side and right-side release/cut buttons 35 diametrically opposed to one another simplifies implementing any required mechanical linkages as well as the routing of the neck lanyard 45.

The leading edge of a tape wrap 60 which is wrapped onto a tape roll 85 passes through the tape exit slot 55. The tape wrap 60 can be a zinc oxide tape, an elastic adhesive bandage, a kinesiology sports tape, an under-wrap, an over-wrap, a cohesive bandage or some other useful tape wrap. Therefore, it should be understood that the particular tape wrap 60 used with the tape wrap dispenser 10 is not intended to be a limiting factor of the present invention.

Refer now to FIG. 2 for a front view of the tape wrap dispenser 10. This front view shows the generally spherical shape of the outer enclosure 15. The left side faces 20 and the right side faces 30 are generally trapezoidal while the center sections 25 are generally rectangular. The flat surfaces are envisioned as being highly useful in preventing or at least resisting the rolling of the tape wrap dispenser 10 when it is set on a flat surface.

FIG. 2 also shows the neck lanyard 45 routed through the center apertures 40 of the release/cut buttons 35. The release/cut buttons 35 are operated by pressing along lines "f" 65 such as by using a finger and a thumb. Pressing causes a cutting blade 95 to cut the tape wrap 60 at the point where it leaves the tape exit slot 55 but preferably not all the way through the end of the tape wrap 60. Then, upon release of the release/cut buttons 35 the end of the tape wrap 60 can be pulled to totally shear it way from the remainder of the tape wrap while a short segment of the tape wrap 60 is advanced to protrude from the tape exit slot 55 for easy grasping and subsequent future use.

Figure 3:
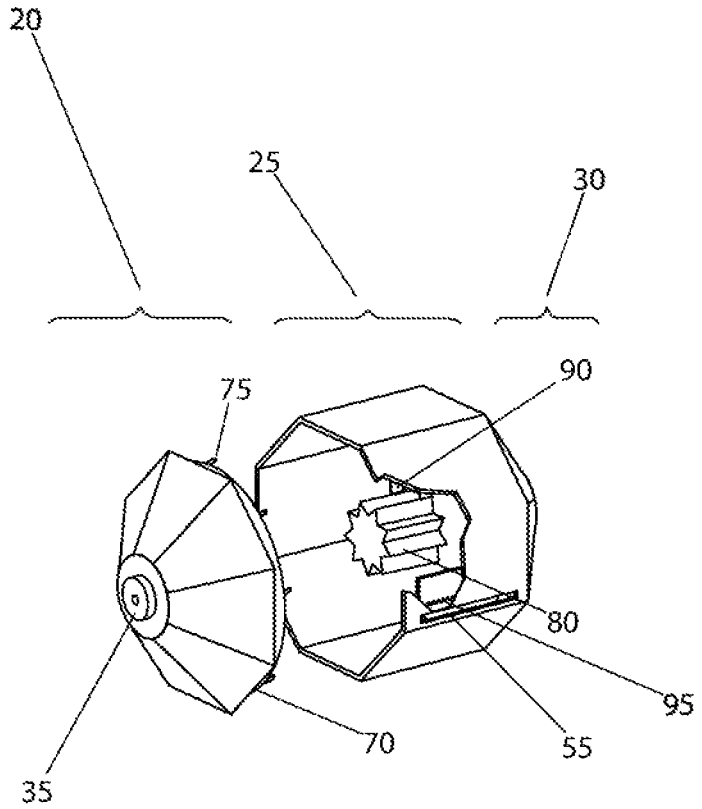
FIG. 3 is an exploded view of the tape wrap dispenser 10 illustrated in FIGS. 1 and 2.

Refer now to FIG. 3 for an exploded view of the tape wrap dispenser 10. The left side faces 20 are engaged with and connected to the center section 25 by a recessed lip 70 having locking tabs 75. When opened as shown in FIG. 3 a central hub 80 that is affixed to the inside of the right side faces 30 is revealed. The central hub 80 holds a roll of tape wrap 85 (see FIG. 4). In practice, the center section 25 is permanently fixed to the right side faces 30.

When the release/cut buttons 35 are operated as described above a linkage cable 90 moves a cutting blade 95 which cuts the tape wrap 60 at the tape exit slot 55 as previously described. For example, the linkage cable 90 may be a "Bowden cable" of the type used for bicycle brakes and gear selection to transmit mechanical power or movement to the butting blade 95.

Figure 4:
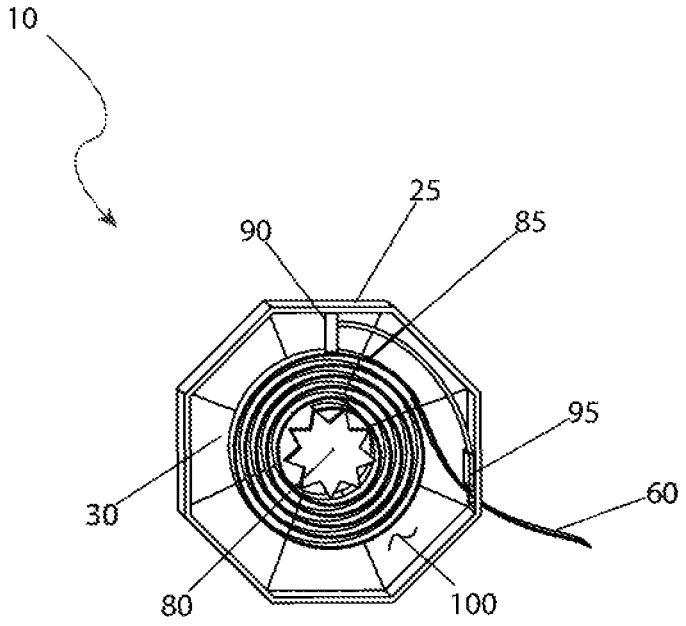
FIG. 4 is a sectional view of the tape wrap dispenser 10 taken along I-I of FIG. 2.

Refer now to FIG. 4 for a sectional view of the tape wrap dispenser 10 taken along line I-I of FIG. 2. The tape wrap roll 85 is shown stowed in position on the central hub 80. The linkage cable 90 is connected to the cutting blade 95. A tape holding cavity 100 is formed by the left and right side faces 20, 30 and by the center section 25. That tape holding cavity 100 is designed to provide adequate space to hold tape wrap rolls 85 of different widths and diameters.

Figure 5:
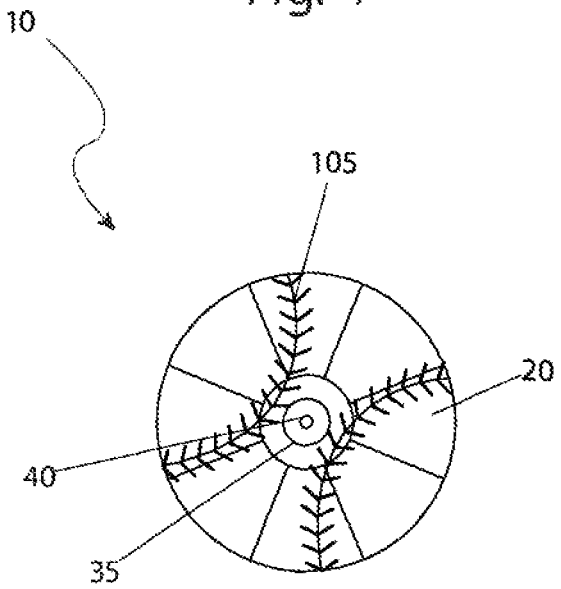
FIG. 5 is side view of a tape wrap dispenser 10 having a baseball motif.
Figure 6:
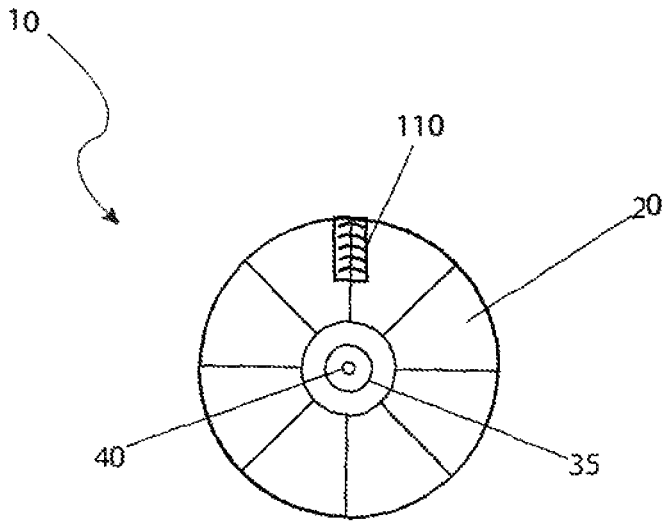
FIG. 6 is side view of a tape wrap dispenser 10 having a football motif.
Figure 7:
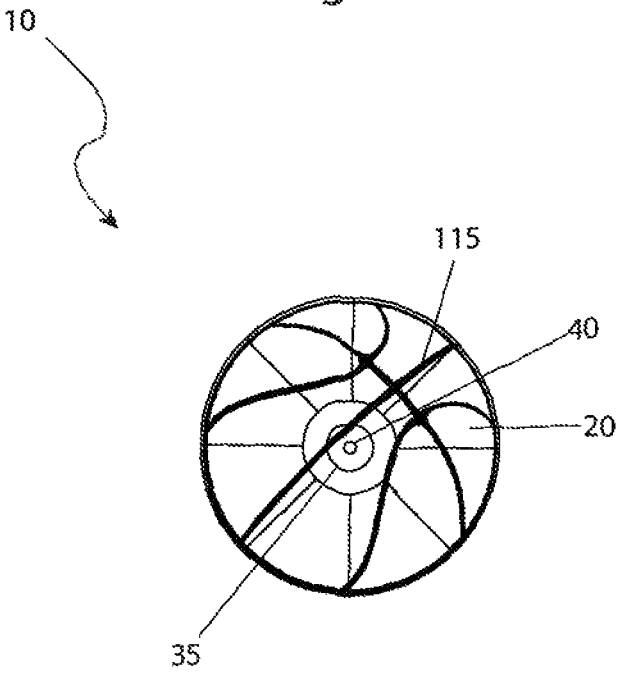
FIG. 7 is side view of an athletic tape dispensing device having a basketball motif.
Figure 8:
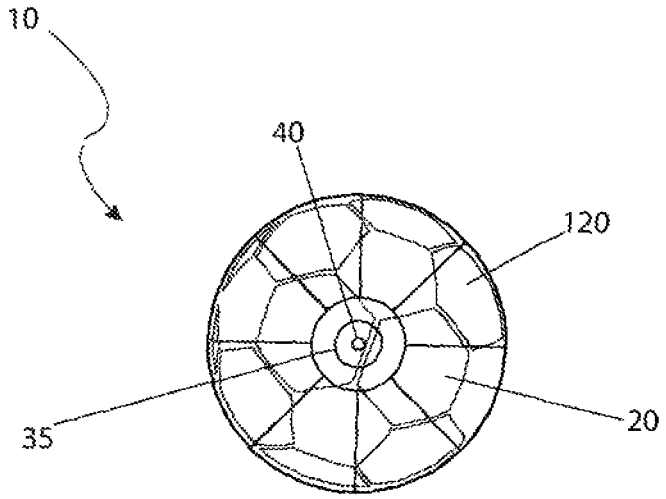
FIG. 8 is side view of a tape wrap dispenser 10 having a soccer motif and, FIG. 9 is side view of a tape wrap dispenser 10 having a tennis ball motif.
Figure 9:
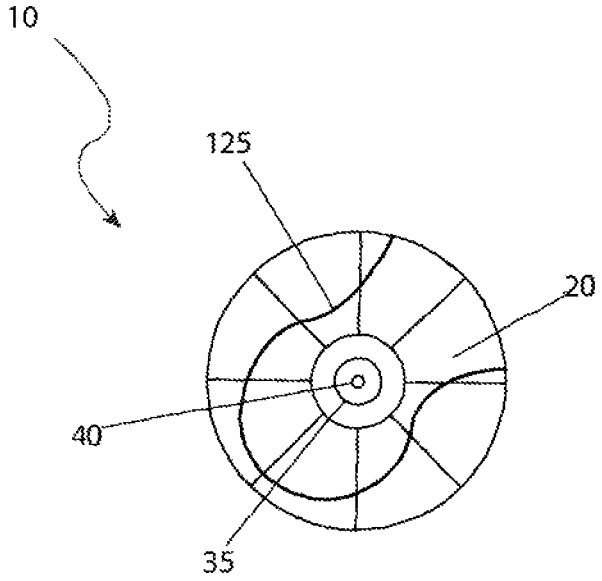

FIG. 5 presents a side view of the tape wrap dispenser 10 when configured to have a baseball motif. As shown the tape wrap dispenser 10 includes baseball marking indicia 105 about the outer enclosure 15. FIG. 6 shows the tape wrap dispenser 10 configured to have a football motif. The tape wrap dispenser 10 is then provided with football marking indicia 110 about the outer enclosure 15. FIGS. 7, 8, and 9 respectively show tape wrap dispenser 10*s* configured to have a basketball motif, a soccer motif and a tennis ball motif. In such cases, and with others, the outer enclosure 15 may include indicia for the motif being shown.

The preferred embodiment of the present invention can be utilized by the common user in a simple and effortless manner with little or no training. It is envisioned that the tape wrap dispenser 10 would be constructed in general accordance with at least FIG. 1 through FIG. 4. The user would procure the tape wrap dispenser 10 from conventional procurement channels such as sporting goods stores or the like. Particular attention would be given to the exterior motif as to regard the sport the tape wrap dispenser 10 would be used with.

After procurement the tape wrap dispenser 10 would be prepared in the following manner: the left side faces 20 would be disconnected from the center section 25 by separating the recessed lip 70 via the locking tabs 75, the desired tape roll 85 would be placed on the central hub 80 with the loose end routed of the tape wrap 60 passing through the tape exit slot 55; the left side faces 20 would be reattached to the center section 25; the neck lanyard 45 would be routed through the center aperture 40; and the anti-choke quick release mechanism 50 would be engaged about the user's neck.

During use, the outer enclosure 15 would be grasped in one (1) hand by the user; the user would then grab the leading edge of the tape wrap 60 and pull the tape wrap 60 from the tape roll 85 until the tape wrap 60 has the desired length; both release/cut buttons 35 would be pressed by the user by applying force along lines "f" 65 using a finger and thumb on one (1) hand while the other hand pulls the now cut leading edge of the tape wrap 60 to free the cut section of the tape wrap 60 from the remainder of the tape wrap 60; and the cut tape 68 would then be used in a normal manner.

The foregoing descriptions of the present invention were presented for purposes of illustration and description. Those descriptions are not intended to be exhaustive or to limit the invention to the precise forms disclosed. Obviously, many modifications and variations are possible considering the above teaching. The embodiments were chosen and described in order to best explain the principles of the invention and its practical application, to thereby enable others skilled in the art to best utilize the invention with various modifications as are suited to the particular use contemplated.

The invention claimed is:

1. An athletic tape wrap dispenser, consisting of:

an outer enclosure having a first side with a first aperture, a center section with a tape exit slot, and a second side with a second aperture;

a first release/cut button attached to said first side of the outer enclosure;

a second release/cut button attached to said second side of the outer enclosure;

a neck lanyard routed through said first aperture and said second aperture;

a central hub inside of said outer enclosure; and an athletic tape wrap roll mounted on said central hub and extending through said tape exit slot;

wherein upon release of the release/cut buttons the end of a tape wrap is pulled to shear it away from a remaining portion of the tape wrap while a short segment of the tape wrap is advanced to protrude from the tape exit slot for easy grasping and subsequent future use;

wherein said first release/cut button is located at the center of said first side;

wherein said second release/cut button is diametrically opposed to said first release/cut button;

wherein said outer enclosure has a plurality of flat surfaces;

wherein said outer enclosure is configured in the shape of a sport that said roll of tape wrap is to be used with;

wherein said first side attaches to said center section by a recessed lip and a plurality of locking tabs;

wherein said central hub is affixed to said second side;

wherein said roll of athletic tape wrap is mounted on said central hub;

wherein said first release/cut button and said first release/cut button are internally connected by said central hub inside of said outer enclosure; and wherein said release/cut buttons are pressed together to cause said central hub to move a linkage cable connected to a cutting blade to move said cutting blade to cut a tape wrap to exit the tape exit slot.

* * * * *